US010173313B1

(12) United States Patent
O'Dell

(10) Patent No.: US 10,173,313 B1
(45) Date of Patent: Jan. 8, 2019

(54) DEVICE FOR CONNECTING A TOOL HANDLE AND AN END EFFECTOR

(71) Applicant: The O'Dell Corporation, Ware Shoals, SC (US)

(72) Inventor: William B. O'Dell, Greenwood, SC (US)

( * ) Notice: Subject to any disclaimer, the term of this patent is extended or adjusted under 35 U.S.C. 154(b) by 201 days.

(21) Appl. No.: 15/235,557

(22) Filed: Aug. 12, 2016

(51) Int. Cl.

| | |
|---|---|
| ***B25G 3/24*** | (2006.01) |
| ***B25G 3/20*** | (2006.01) |
| ***B25G 3/26*** | (2006.01) |
| ***B25G 3/30*** | (2006.01) |
| ***A47L 13/20*** | (2006.01) |
| ***A46B 9/02*** | (2006.01) |

(52) U.S. Cl.
CPC ..... *B25G 3/24* (2013.01); *A46B 9/02* (2013.01); *A47L 13/20* (2013.01); *B25G 3/20* (2013.01); *B25G 3/26* (2013.01); *B25G 3/30* (2013.01); *Y10T 16/469* (2015.01)

(58) Field of Classification Search
CPC ..... Y10T 16/44; Y10T 16/469; Y10T 16/48; Y10T 16/4713; Y10S 16/24; B25G 3/00; B25G 3/12; B25G 3/24; B25G 3/20; B25G 3/26; B25G 3/30; B25G 1/04; B25G 1/06; A46B 9/02; A47L 13/20
USPC ..... 16/110.1, 422, 431, 426, DIG. 24; 15/143.1, 146, 147.1, 176.2, 176.5, 176.6, 15/229.2, 22.1, 145; 294/57, 58; 81/489
See application file for complete search history.

(56) References Cited

U.S. PATENT DOCUMENTS

| | | | | | |
|---|---|---|---|---|---|
| 1,400,954 | A * | 12/1921 | Holloway | A46B 5/0095 | 132/311 |
| 5,210,898 | A * | 5/1993 | Carey | B25G 3/30 | 15/145 |
| 5,996,162 | A * | 12/1999 | Hsu | B25G 1/04 | 15/144.1 |
| 6,154,913 | A * | 12/2000 | Burton | A47K 11/10 | 15/104.2 |
| 6,609,847 | B1 * | 8/2003 | Wang | A46B 11/06 | 15/144.4 |
| 6,634,822 | B1 * | 10/2003 | Wang | A46B 11/063 | 15/144.4 |
| 6,830,271 | B2 * | 12/2004 | Piscopo | A01B 1/026 | 16/426 |
| 9,174,335 | B1 | 11/2015 | O'Dell | | |
| 2003/0061676 | A1 * | 4/2003 | Warren | A47K 7/028 | 15/176.2 |
| 2003/0180085 | A1 * | 9/2003 | Hughes | A01B 1/227 | 401/289 |

(Continued)

*Primary Examiner* — William L Miller
(74) *Attorney, Agent, or Firm* — Nexsen Pruet, LLC; Michael A. Mann

(57) ABSTRACT

A device and tool include a fitting and a coupler for joining a handle and an end effector such as a broom or mop so that the handle cannot twist with respect to the end effector. The first end of the fitting attaches to the handle. The first end of the coupler threads to the second end of the fitting, and its second end threads to the end effector. Both the fitting and coupler have diametrical passages. A stopper on the coupler will seat in a ramp in the fitting when the coupler and fitting are fully threaded together and the stopper reaches the end wall of the ramp so the user knows the coupler and fitting are aligned. A clip holds the diametrical passages of the fitting and coupler in alignment to prevent twisting.

21 Claims, 5 Drawing Sheets

(56) References Cited

U.S. PATENT DOCUMENTS

| | | | | |
|---|---|---|---|---|
| 2005/0273951 | A1* | 12/2005 | Karl | A61C 17/22<br>15/22.1 |
| 2014/0331425 | A1* | 11/2014 | Baker | A47K 11/10<br>15/114 |

* cited by examiner

DEVICE FOR CONNECTING A TOOL HANDLE AND AN END EFFECTOR

TECHNOLOGICAL FIELD

The disclosure relates to tools generally and to those having a long handle that is fastened to an end effector, such as a broom or mop.

BACKGROUND

Many tools for housekeeping and gardening have handles with end effectors. For convenience, these various tools will simply be referred to herein as tools. End effectors attached to the ends of the handles are designed for mechanical purposes, such as sweeping, brushing, scraping, raking, cutting, mixing, weeding, hoeing, and so forth, and include mop heads, brush blocks, rake tines, scrapers, and transverse blades for hoeing. The connection between the handles and end effectors may be permanent, it may be a simple friction fitting perhaps secure by screws, or it may be a threaded connection such as that shown in FIG. 1.

A threaded connection, while facilitating more compact shipping of tools, is often unsatisfactory. In use, particularly with wider end effectors, the ends of which may be subject to unequal forces, the end effector tends to loosen from the handle. One solution to this problem is disclosed in U.S. Pat. No. 9,174,335, which is incorporated by reference herein in its entirety.

SUMMARY OF THE INVENTION

The present invention is tool with a securely attached end effector, a tool including a handle with a coupler for an end effector, and a device for connecting a handle to an end effector. The fitting and the coupler are threaded together and pinned using a clip to prevent rotation of one respect to the other. The coupler may be threaded to or glued to the end effector.

An aspect of the disclosure is a tool including a handle, an end effector with a threaded hole, a fitting with its first end attached to the handle and its second end having a first recess formed in it thereby defining a wall. The wall carries interior threads. The second end of the fitting has a first diametrical passage formed across it. The tool also includes coupler with a first end and a second end opposing the first end. The first end of the coupler carries exterior threads dimensioned to be threaded to the interior threads of the wall of the second end of the fitting. The second end of the coupler also has exterior threads that thread into the threaded hole of the end effector. The first end of the coupler also has a second diametrical passage formed thereacross so that, when the first end of the coupler is threaded to the second end of the fitting, the second diametrical passage of the coupler coaxially aligns with the first diametrical passage of the fitting.

An aspect of the disclosure is a clip having a pin and opposing arms. The pin is dimensioned to pass through the first and second diametrical passages of the fitting and the coupler when they are aligned, and the opposing arms of the clip grip the fitting. The clip may also have a pull tab.

An aspect of the disclosure is that the second end of the fitting has a ramp formed in the fitting recess, and the first end of the coupler carries a stopper on the rim of its wall. When the stopper on the coupler is seated in the ramp in the first recess of the second end of the fitting, the first and second diametrical passages are axially aligned. The stopper is seated when it reaches the end wall of the ramp.

Another aspect of the disclosure is that the ramp has a pitch. The threads of the first end of the coupler also have a pitch, and wherein the pitch of the ramp and the pitch of the threads of the first end of the coupler are the same.

Another aspect of the disclosure is a post oriented axially inside the fitting recess of the second end of the fitting. The post has a transverse hole formed therein that is aligned with the first diametrical passage of the second end of the fitting so as to coincide with and become part of the first diametrical passage.

An aspect of the disclosure is that the first end of the coupling has a coupling recess formed therein, the coupling recess being defined by an axial wall that carries exterior threads. The axial wall also has a rim that carries the stopper. The post of the second end of the fitting is dimensioned to fit inside the coupling recess.

An aspect of the disclosure is a device with a handle having an integral fitting. The fitting has a fitting recess formed in it that defines a wall having interior threads and a first diametrical passage formed through the wall. The fitting recess also has a ramp formed therein. The device further includes a coupler with a first end and a second end. The first end carries exterior threads dimensioned for threading to the fitting recess in the fitting. The first end of the coupler has a second diametrical passage across it. When the first end of the coupler is threaded to the fitting, the second diametrical passage of the coupler coaxially aligns with the first diametrical passage. The first end of the coupler also carries a stopper dimensioned to be received in the ramp in the fitting recess of the fitting when the first end of the coupler is seated in the fitting recess and the stopper is seated in the ramp, at which point the first and second diametrical passages are axially aligned.

Another aspect of the disclosure is that the device has an end effector, such as a broom or a mop, for example, attached to the second end of the coupler. The end effector may have a threaded hole formed therein. The second end of the coupler carries exterior threads to thread it into the threaded hole of the end effector.

An aspect of the disclosure is a device that includes a fitting having a first end and a second end. The second end of the fitting has a fitting recess formed therein that defines a wall and that has interior threads formed thereon. The second end of the fitting has a first diametrical passage formed across it and a ramp formed in the fitting recess. The tool also includes a coupler with a first end and an opposing second end. The first end of the coupler carries exterior threads dimensioned to be threadedly received in the fitting recess. The first end of the coupler has a second diametrical passage formed thereacross so that, when the first end of the coupler is threaded into the fitting recess in the second end of the fitting, the second diametrical passage of the coupler coaxially aligns with the first diametrical passage of the fitting. The first end of the coupler carries a stopper dimensioned to be received in the ramp of the fitting recess. When the stopper is seated in the ramp, the first and second diametrical passages align axially.

These and other aspects of the disclosure will be apparent to those skilled in the art of tools with handles and end effectors from a careful reading of the Detailed Description accompanied by the drawings.

DETAILED DESCRIPTION OF EMBODIMENTS

The present disclosure teaches a device for use with a handle and an end effector, such as a broom or mop, a tool that has an end effector, and device for use with an end effector.

Figure 1:
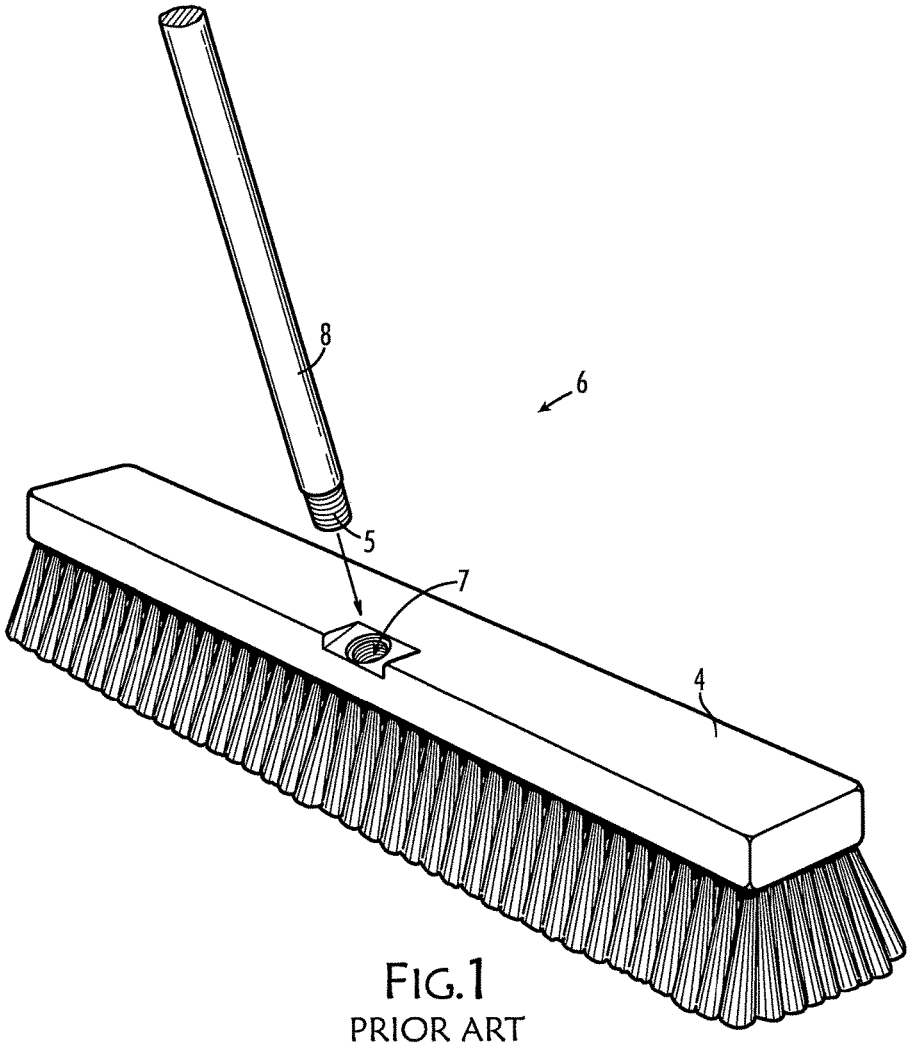
FIG.1 PRIOR ART
FIG. 1 is a perspective, exploded view of a prior art floor broom with handle and brush block, as one type of end effector, and showing the threaded end of handle and the threaded hole in the brush block.

FIG. 1 illustrates an exploded view of a prior art tool, namely, a broom 6, with a brush block 4 and a handle 8. The threaded end 5 of handle 8 is poised over the threaded hole 7 of brush block 4.

Figure 2:
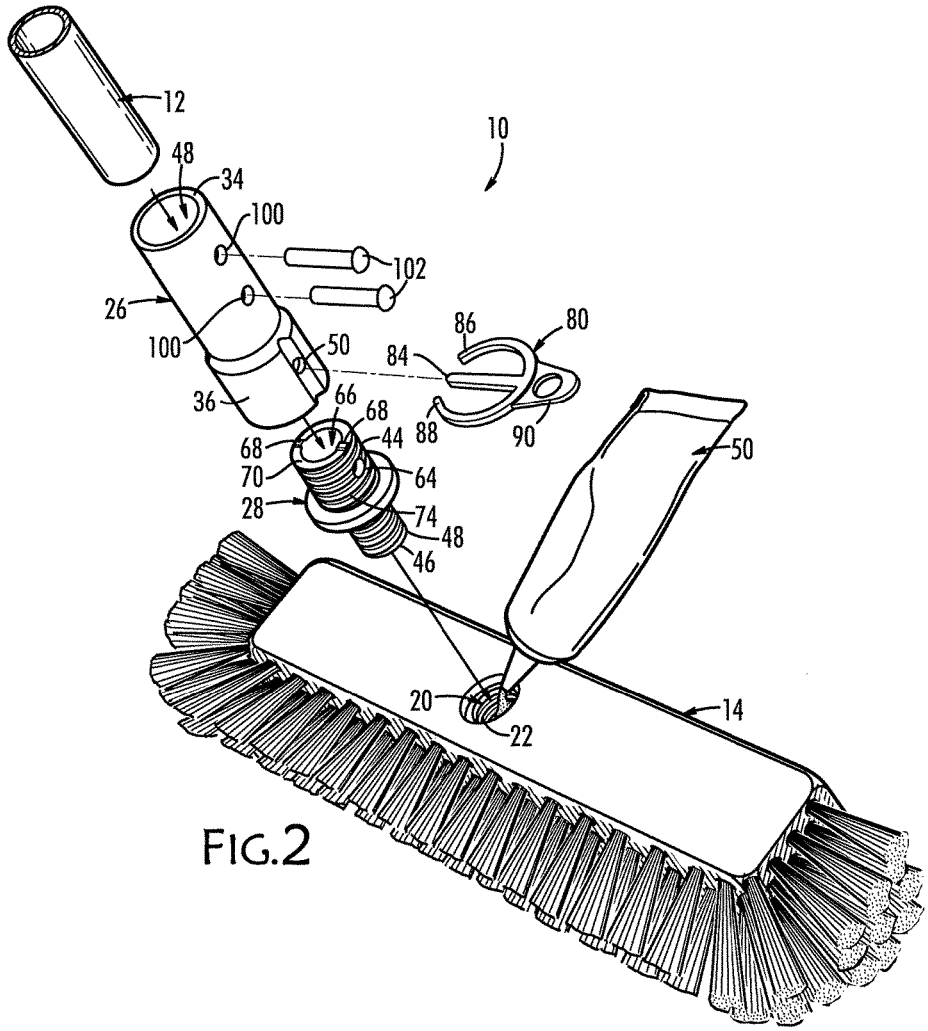
FIG. 2 is a perspective, exploded view of the present floor broom with handle and brush block type of end effector, and showing the fitting, coupler, rivets and clip, as well as the application of an adhesive to secure the second end of the coupler to the brush block, according to an aspect of the disclosure.
Figure 3:
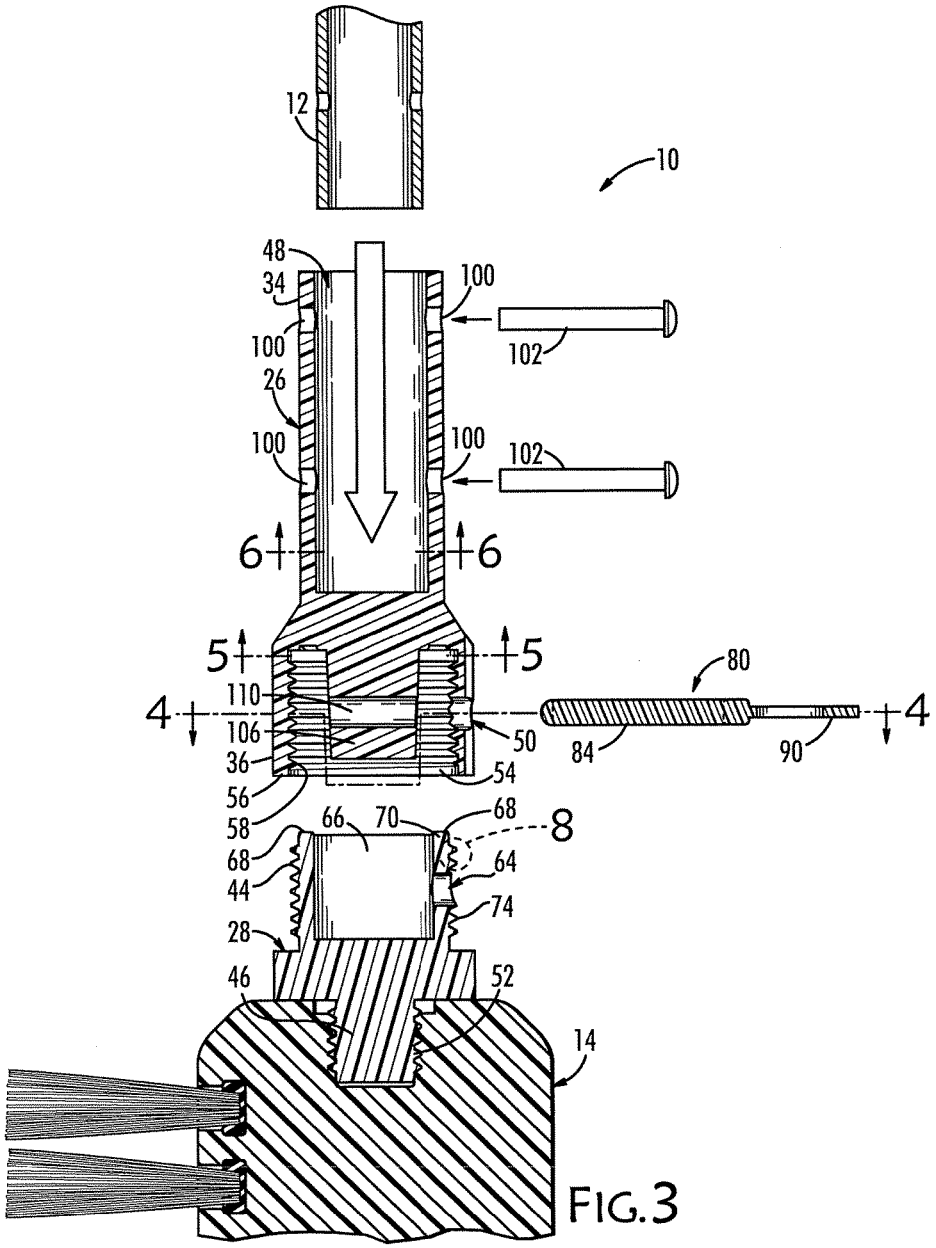
FIG. 3 is a side, exploded, cross-sectional view of the floor broom of FIG. 2 showing the recess in the first end of the fitting for the handle, the interior threads and post with its transverse hole in the second end of the fitting, and the exterior threads of the first end of the coupler, according to an aspect of the disclosure.
Figure 4:
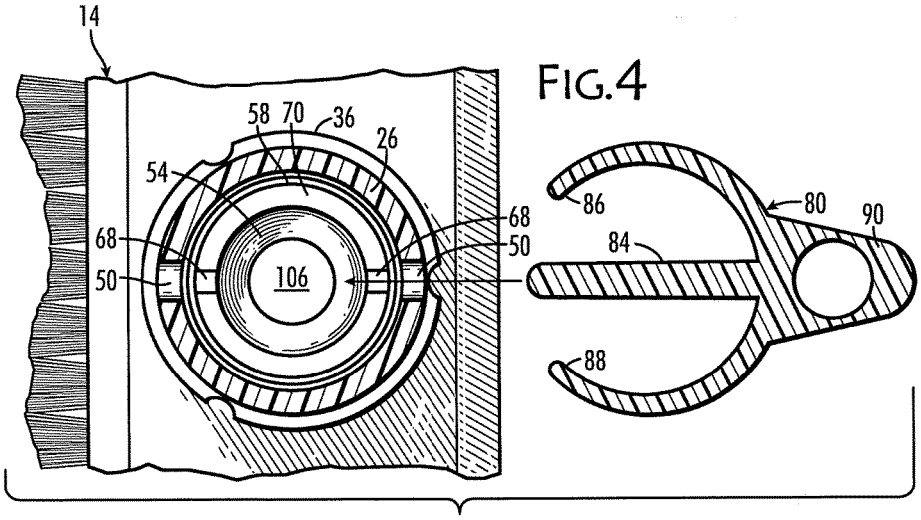
FIG. 4 is a cross-sectional view taken along lines 4-4 of FIG. 3, when the components of FIG. 3 are assembled, to show the relationship between the coupler and the fitting as well as the positions of the pin and arms of the clip, according to an aspect of the disclosure.

The present tool, generally indicated by reference number 10 in FIGS. 2-4, includes a handle 12 and an end effector 14 with a threaded hole 20 formed in it. End effector 14 is shown as a brush block in FIGS. 2-4 but other end effectors may be substituted. For example, end effector 14 may be a mop head, a floor sponge, a rake, or a garden implement. Handle 12 may be made of wood, plastic, metal, or composite material or combinations of these such as metal- or fiber-reinforced plastic. Handle 12 may be hollow, as shown, or solid.

A fitting 26 and a coupler 28 are used to connect handle 12 to end effector 14. The term fitting is used herein to indicate an attachment to the end of handle 12 that alters the configuration of that end so that handle 12 can be joined to coupler 28. It will be clear that the end of handle 12 can be configured in advance by making fitting 26 integral with handle 12 so that the end of handle 12 is a fitting and can thereby cooperate with coupler 28.

Fitting 26 has a first end 34 dimensioned to receive handle 12 and an opposing second end 36, dimensioned to receive coupler 28. Fitting 26 may for example, have a channel 48 formed in first end 34 to receive handle 12. Coupler 28 has a first end 44 and an opposing second end 46 that carries exterior threads 52 for threading second end 46 to threaded hole 20 in end effector 14. Alternatively, second end 46 of coupler 28 may be glued into threaded hole 20 using adhesive for permanent attachment, or second end 46 of coupler 28 may be both glued and threaded to end effector 14.

First end 34 of fitting 26 may be fastened to or integral with handle 12. Integral means both are formed of the same material. If fastened to first end 34 of fitting 26, handle 12 may be attached in any convenient way, such as, by forming channel 48 in first end 34 of fitting 26 dimensioned for receiving handle 12 and then using fasteners 102 such as rivets, screws or pins inserted through holes 100 to hold handle 12 in first end 34 of fitting 26. Second end 36 of fitting 26 has fitting recess 54, best seen in FIG. 3 and FIG. 4, which defines a wall 56 with interior threads 58 and with a diametrical passage 50 formed thereacross. The term diametrical passage means that there is an obstruction-free, passage across at least a portion of a diameter of a body, in this case in second end 36 of fitting 26.

First end 44 of coupler 28 may have a second recess 66 formed therein that defines a wall 70. Wall 70 of coupler 28 carries exterior threads 74 and is threadable to interior threads 58 of wall 56 of second end 36 of fitting 26. Using a threaded fitting provides a more secure, rigid fitting and, with sufficiently tight tolerances, helps to align diametrical passages 50, 64 of fitting 26 and coupler 28, respectively.

Figure 5:
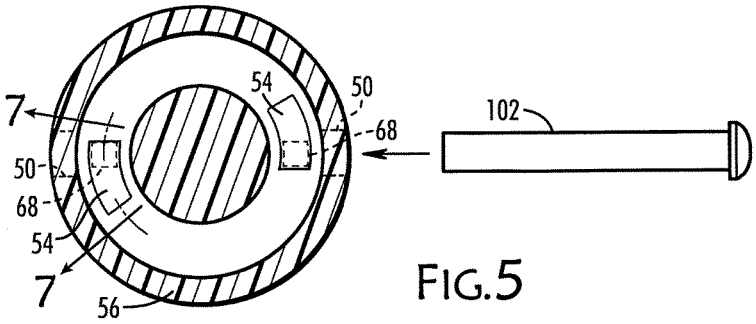
FIG. 5 is a cross-sectional view taken along lines 5-5 of FIG. 3, when the components of FIG. 3 are assembled, to show the relationship between the coupler and the fitting as well as the position of the rivet, according to an aspect of the disclosure.
Figure 6:
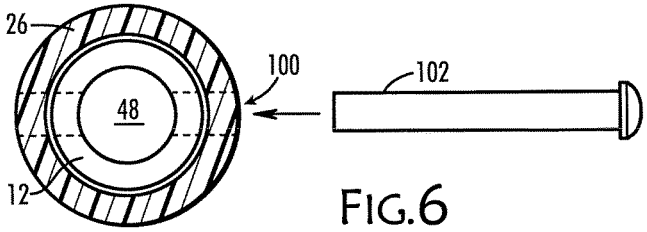
FIG. 6 is a cross-sectional view taken along lines 6-6 of FIG. 3, when the components of FIG. 3 are assembled, to show the relationship between the coupler and the fitting as well as the position of the rivet, according to an aspect of the disclosure.
Figure 7:
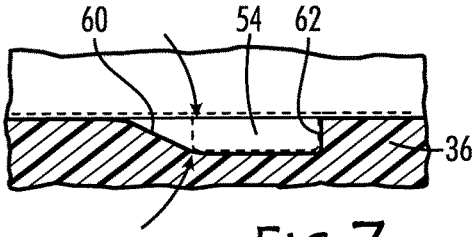
FIG. 7 is a cross-sectional view of a coupler partially threaded to a fitting, showing stopper near the entrance to ramp, according to an aspect of the disclosure.
Figure 8:
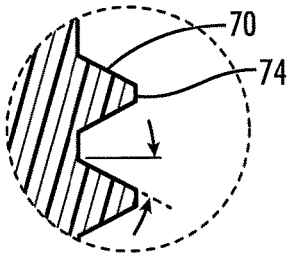
FIG. 8 is a cross sectional view of a coupler fully threaded to a fitting showing stopper seated in the ramp and against the end wall, according to an aspect of the disclosure.

In addition, fitting recess 54 has a ramp 60, best seen in FIGS. 5 and 7, having an end wall 62 formed therein and coupler carries a stopper 68. Stopper 68 is carried on a rim 72 of wall 70. When fitting 26 and coupler 28 are threaded together, stopper 68 will enter ramp 60 and reach end wall 62 where the advance of coupler 28 stops. At that point first and second diametrical passages 50, 64 will be in alignment.

Ramp 60 has a pitch A, which is the ratio of the depth of ramp 60 to its length. Interior threads 58 of second end 36 of fitting 26 or exterior threads 74 of wall 70 of coupler 28 also have a pitch B, which is a the ratio of the axial movement of coupler and wall with respect to each other with respect to the circumferential distance required for that movement. Pitch A and B may be the same so that stopper 68 moves smoothly into ramp 60 as fitting 26 and coupler 28 rotate. By pitch A and pitch B being the same, it is meant that they are similar enough so that stopper 68 moves steadily down ramp 60 as coupler 28 is rotated into fitting recess 54.

Finally, the present invention includes a clip 80 that has a pin 84 and two opposing arms 86, 88, as best seen in FIG. 4. Pin 84 is used to hold fitting 26 and coupler 28 together and prevent their rotation with respect to each other. Pin 84 is dimensioned to pass through the aligned diametrical passages 50, 64 in fitting 26 and coupler 28, respectively, when they are fully fitted together, and opposing arms 86, 88, partially encircling fitting 26 to grip fitting 26. Opposing arms 86, 88, help to hold pin 84 in position. Clip 80 may also have a pull tab 90 to facilitate its removal from fitting 26 when handle 12 and fitting 26 are to be separated from coupler 28 and end effector 14.

First end 34 of the fitting 26 may have one or more holes 100 formed in it to receive fasteners 102, such as screws, nails or rivets, one in each hole 100, that pass through hole 100 and into the material of handle 12 to secure first end 34 of fitting 26 to handle 12.

Recess 54 in second end 36 of fitting 26 may also have a post 106, oriented axially with respect to handle 12 and spaced apart from wall 56 defined by fitting recess 54. Post 106 may have a groove 110, slot or hole formed therein, depending on its axial length that is aligned with diametrical passage 50 of fitting 26 and with diametrical passage 64 of coupler 28 to receive pin 84 of clip 80. Post 106 provides additional stability, strength and resists twisting of pin 84 of clip 80.

Fitting 26 may be made integral to handle 12 or may be a separate component.

Figure 9:
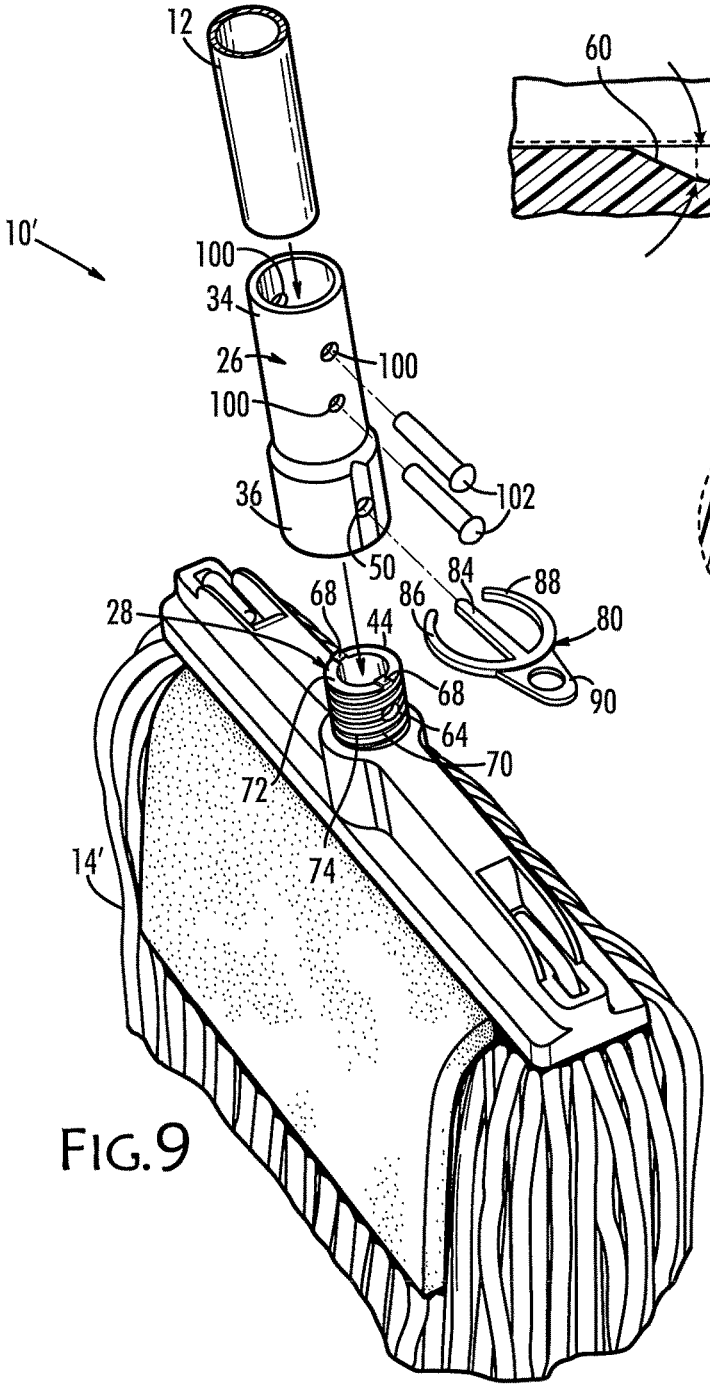
FIG. 9 is a perspective, exploded view of an alternative embodiment of the present invention with a mop head type of end effector, according to the present invention.

FIG. 9 shows an alternative end effector 14' for a tool 10', namely, a mop head 14' but all of the components are otherwise essentially the same as for those shown in FIGS. 1-4. Other end effectors may also be used where a simple connection is needed that does not rotate but remains firm during use of the tool but is otherwise removable when convenient or when the end effector is worn and needs to be replaced or when a different end effector is needed.

It will be clear to those skilled in the art of making housekeeping and gardening tools that many modifications and substitutions may be made to the disclose tool described herein without departing from the spirit and scope of the present disclosure.

What is claimed is:

1. A tool, comprising:

(a) an end effector with a threaded hole;

(b) a handle;

(c) a fitting having a first end attached to said handle and an opposing second end having a fitting recess formed therein to define a wall, said wall having interior threads thereon, and said fitting having a first diametrical passage formed through said wall of said second end;

(d) a coupler having a first end and a second end opposing said first end of said coupler, said first end of said coupler carrying exterior threads dimensioned for threading said first end of said coupler into said fitting recess of said fitting, said first end of said coupler having a second diametrical passage formed thereacross wherein, when said first end of said coupler is threaded to said second end of said fitting, said first end of said second diametrical passage of said coupler coaxially aligns with the first diametrical passage of the fitting, and wherein said second end of the coupler has exterior threads that thread into said threaded hole of said end effector, said first end of said coupler carrying a stopper thereon, and wherein, when said first end of said stopper is seated in said fitting recess of said second end of said fitting, said first diametrical passage and said second diametrical passage axially align; and (e) a clip having a pin, said pin dimensioned to pass through said first and second diametrical passages.

2. The tool as recited in claim 1, wherein said fitting recess in said second end of said fitting has a ramp formed therein and said ramp has a pitch, and wherein threads of said first end of said coupler have a pitch and wherein said pitch of said ramp and said pitch of said threads of said first end of said coupler are the same.

3. The tool as recite in claim 2, wherein said ramp has an end wall, and wherein, when said stopper engages said end wall of said ramp in said recess of said second end of said fitting, said first end of said coupler is prevented from further forward movement into said recess of said second end of said fitting.

4. The tool as recited in claim 1, further comprising a fastener, said fastener fastening said first end of said fitting to said handle.

5. The tool as recited in claim 1, further comprising a post oriented axially inside said fitting recess of said second end of said fitting, said post having a transverse hole formed therein and aligned with said first diametrical passage of said second end of said fitting so as to coincide with said first diametrical passage.

6. The tool as recited in claim 1, wherein said first end of said coupler has a coupler recess formed therein, said coupler recess defining an axial wall, said axial wall carrying said exterior threads.

7. The tool as recited in claim 6, wherein axial wall has a rim and wherein said stopper is carried by said rim of said axial wall.

8. The tool as recited in claim 1, wherein said second end of said fitting has a post oriented axially inside said fitting recess of said second end, said post having a transverse hole formed therein and aligned with said first diametrical passage of said second end of said fitting so as to continue said first diametrical passage, and wherein said first end of said coupler has a coupler recess formed therein, said coupler recess defining an axial wall, said axial wall carrying said exterior threads of said first end of said coupler, said post of said second end of said fitting being dimensioned to be receivable in said coupler recess.

9. The tool as recited in claim 1, wherein said clip further comprises opposing arms.

10. A device, comprising:

(a) a handle having fitting recess formed therein, said recess defining a wall, said wall having interior threads and a first diametrical passage formed across said second end of said handle, through said wall and across said fitting recess; and (b) a coupler having a first end and a second end opposing said first end of said coupler, said first end of said coupler carrying exterior threads dimensioned for threading into said fitting recess in said second end of said handle, said first end of said coupler having a second diametrical passage formed thereacross, wherein, when said first end of said coupler is threaded to said second end of handle, said second diametrical passage of said coupler coaxially aligns with said first diametrical passage of said second end of said handle, said first end of said coupler carrying a stopper on said first end of said coupler, and wherein when said stopper seats in said recess of said second end of said handle, said first and said second diametrical passages are axially aligned.

11. The device of claim 10, wherein said fitting recess of said handle has a ramp formed therein, and wherein, when said first end of said coupler is threaded to said second end of said handle, said first and said second diametrical passages axially align when said stopper seats in said ramp.

12. The device of claim 10, further comprising an end effector, said end effector being attached to said second end of said coupler.

13. The device of claim 12, wherein said end effector has a recess with interior threads formed therein and said second end of said coupler carries exterior threads so that said exterior threads of said second end of said coupler thread to said interior threads of said recess of said end effector.

14. The device of claim 12, wherein said end effector is a broom.

15. The device of claim 12, wherein said end effector is a mop.

16. The device as recited in claim 10, further comprising a clip having a pin and opposing arms, said pin being dimensioned to pass through said first and second diametrical passages wherein said clip further comprises opposing arms, said arms gripping said second end of said handle when said pin of said clip is inserted into said first and second diametrical passages.

17. A device, comprising:

(a) a fitting having a first end and a second end opposing said first end, said second end having a fitting recess formed therein, said fitting recess defining a wall, said wall having interior threads, and said fitting having a first diametrical passage formed across said second end, said fitting recess having a ramp formed therein; and (b) a coupler having a first end and a second end opposing said first end, said first end of said coupler carrying exterior threads and being dimensioned to be received in said second end of said fitting, said first end of said coupler having a second diametrical passage formed thereacross, said first end of said coupler carrying a stopper, and wherein, when said stopper of said first end of said coupler seats in said ramp of said second end of fitting, said second diametrical passage of said coupler coaxially aligns with first diametrical passage of said fitting.

18. The device of claim 17, further comprising a clip having a pin and opposing arms, said pin dimensioned to pass through said first and second diametrical passages and said opposing arms grip said fitting when said first and second diametrical passages are axially aligned.

19. The device of claim 17, wherein said ramp has a pitch and wherein threads of said first end of said coupler have a pitch and wherein said pitch of said ramp and said pitch of said threads of said first end of said coupler are the same.

20. The device of claim 17, wherein said ramp has an end wall and wherein said stopper is seated in said ramp when said stopper reaches said end wall.

21. The device of claim 17, wherein said first end of said coupler has a rim and wherein said stopper is carried by said rim of first end of said coupler.

* * * * *